United States Patent [19]

Zunkel et al.

[11] Patent Number: 4,633,944

[45] Date of Patent: Jan. 6, 1987

[54] GRAVEL PACKER

[75] Inventors: Gary D. Zunkel, Chickasha, Okla.; Michael L. Bolin, Knoxville, Tenn.

[73] Assignee: Halliburton Company, Duncan, Okla.

[21] Appl. No.: 756,885

[22] Filed: Jul. 19, 1985

[51] Int. Cl.[4] ..... E21B 43/04

[52] U.S. Cl. ..... 166/51; 166/278

[58] Field of Search ..... 166/51, 278, 188, 331, 166/237, 240

[56] References Cited

U.S. PATENT DOCUMENTS

| | | | |
|---|---|---|---|
| 3,153,451 | 2/1963 | Chancellor et al. | 166/51 |
| 3,421,586 | 1/1969 | Solum | 166/51 |
| 3,637,010 | 1/1972 | Maly et al. | 166/51 |
| 3,710,862 | 1/1973 | Young et al. | 166/278 |
| 3,726,343 | 4/1973 | Davis, Jr. | 166/278 |
| 3,901,318 | 8/1975 | Fortenberry | 166/278 |
| 3,913,676 | 10/1975 | Barbee, Jr. et al. | 166/278 |
| 3,926,409 | 12/1975 | Abney et al. | 166/331 X |
| 3,952,804 | 4/1976 | Smyrl | 166/278 |
| 3,963,076 | 6/1976 | Winslow | 166/278 |
| 3,987,854 | 10/1976 | Callihan et al. | 166/278 |
| 4,044,832 | 8/1977 | Richard et al. | 166/278 |
| 4,049,055 | 9/1977 | Brown | 166/278 |
| 4,105,069 | 8/1978 | Baker | 166/51 |
| 4,192,375 | 3/1980 | Maly et al. | 166/51 |
| 4,273,190 | 6/1981 | Baker et al. | 166/278 |
| 4,295,524 | 10/1981 | Baker et al. | 166/278 |
| 4,296,807 | 10/1981 | Hendrickson et al. | 166/184 |
| 4,418,754 | 12/1983 | Stepp | 166/278 |
| 4,428,428 | 1/1984 | Smyrl et al. | 166/278 |
| 4,438,815 | 3/1984 | Elson et al. | 166/278 |
| 4,440,218 | 4/1984 | Farley | 166/51 |
| 4,474,239 | 10/1984 | Colomb et al. | 166/278 |

*Primary Examiner*—Stephen J. Novosad
*Assistant Examiner*—Thuy M. Bui
*Attorney, Agent, or Firm*—Joseph A. Walkowski

[57] ABSTRACT

The present invention relates to a weight-set single-zone gravel packer which may be left in place after gravel packing attached to the screen as a production packer. The gravel packer includes a compression-set packer element, ratchet means to releasably lock the gravel packer in a set mode, intake passage to receive fluid from a tubing string, a return passage to receive fluid from the interior of a gravel screen below the gravel packer; closeable crossover means to transmit fluid from the return passage to the wellbore annulus above the gravel packer; first check valve means to prevent flow down to the gravel screen through the return passage; and second check valve means adapted to selectively connect the return passage with the outside of the gravel packer; and J-slot means for selectively disconnecting the crossover means and tubing string from the gravel packer.

18 Claims, 15 Drawing Figures

GRAVEL PACKER

BACKGROUND OF THE INVENTION

This invention relates to a tool for use in gravel packing wells. More specifically, the invention relates to a gravel packing tool for effecting a circulate-squeeze type gravel pack.

In wells in geological formations where the production of sand from the formation along with the liquids and gases being produced therefrom is a problem, it is well known in the art to install a screen in the production tubing and pack gravel around the screen to prevent the sand from the formation flowing into the production tubing. In such an arrangement, a gravel pack screen assembly is run into the formation on a string of tubing to the desired location and gravel, typically a slurry of coarse sand mixed in a gelled liquid, is pumped down to the exterior of the gravel pack screen assembly to fill the area between the screen assembly and the formation. After a sufficient amount of gravel has been pumped down to the exterior of the gravel pack screen assembly to completely fill the area between the screen assembly and the formation, the screen assembly is released from the tubing string and the tubing removed from the well with production tubing subsequently being installed in the well.

It is common to circulate the gravel-laden liquid outside the screen assembly, and to return the liquid through the screen to the surface, leaving the gravel in place around the screen assembly. After the initial circulation, the operator may want to further consolidate the gravel pack, which is done through squeezing, or applying pressure to the gravel pack after closing the circulation path used to return the gravel-laden liquid to the surface. It is also desirable to reverse-circulate gravel-laden fluid out of the tubing string and gravel pack screen assembly prior to retrieving it from the wellbore.

SUMMARY OF THE INVENTION

The present invention relates to a weight-set single-zone gravel packer which may be left in place after gravel packing attached to the screen as a production packer. The gravel packer includes a compression-set packer element, ratchet means to releasably lock the gravel packer in a set mode, intake passage to receive fluid from a tubing string, a return passage to receive fluid from the interior of a gravel screen below the gravel packer; closeable crossover means to transmit fluid from the return passage to the wellbore annulus above the gravel packer; first check valve means to prevent flow down to the gravel screen through the return passage; and second check valve means adapted to selectively connect the return passage with the outside of the gravel packer; and J-slot means for selectively disconnecting the crossover means and tubing string from the gravel packer.

BRIEF DESCRIPTION OF THE DRAWINGS

The present invention will be more readily understood by one of ordinary skill in the art through a review of the following detailed description of the preferred embodiment, taken in conjunction with the accompanying drawings, wherein.

DETAILED DESCRIPTION OF THE PREFERRED EMBODIMENT

Figure 1A:
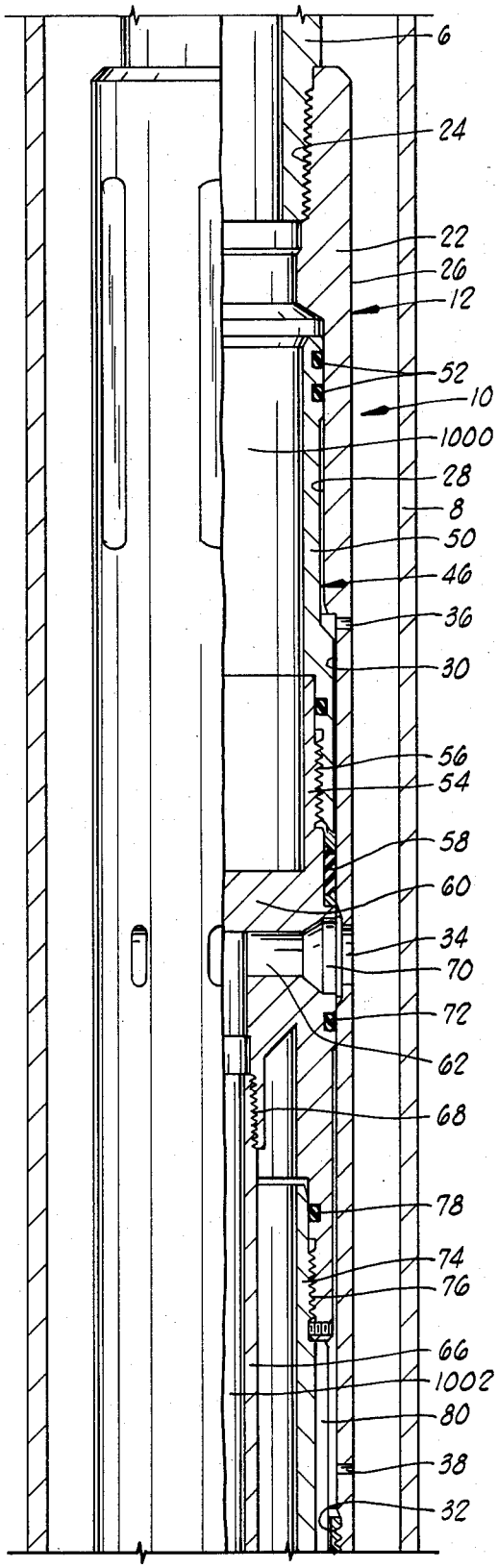
FIGS. 1A–1G comprise a detailed half-section elevation of the gravel packer of the present invention disposed in a cased wellbore in an unset mode.
Figure 1B:
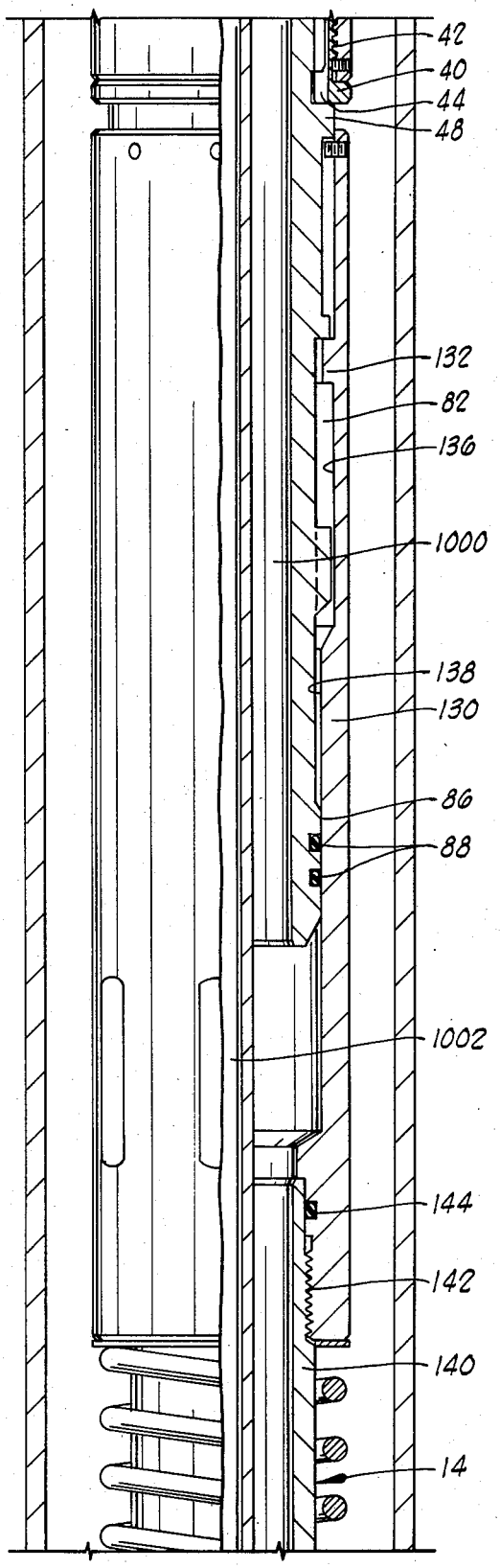
Figure 1C:
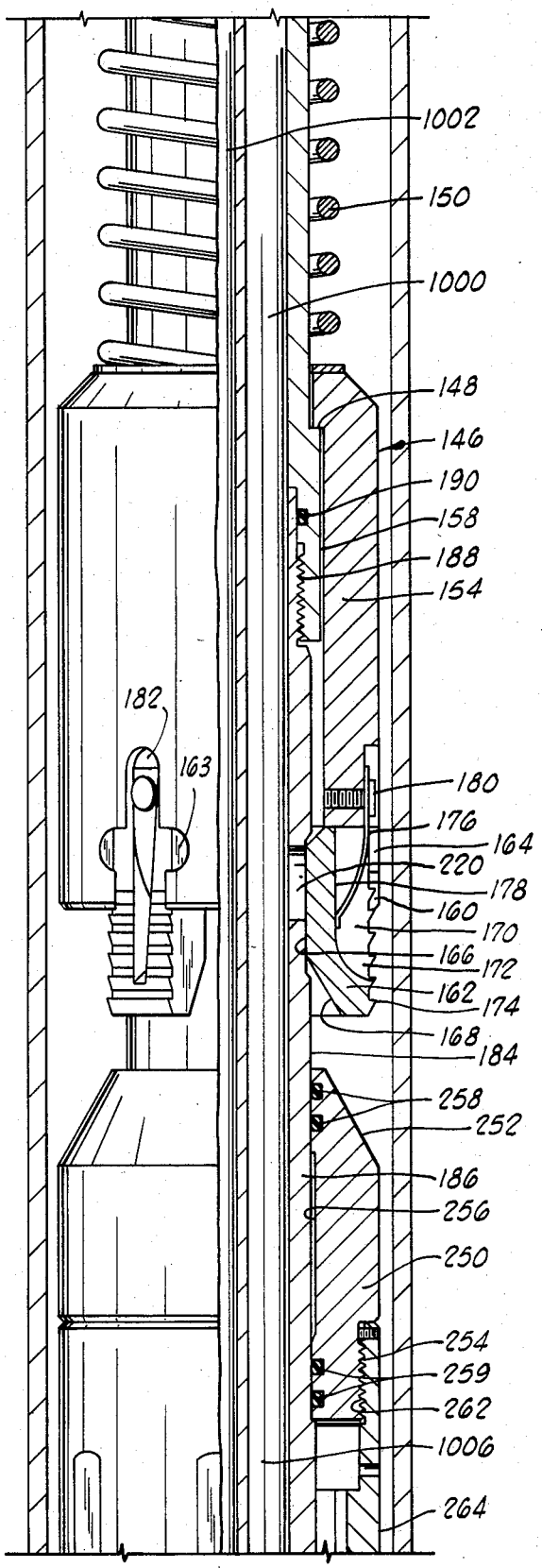
Figure 1D:
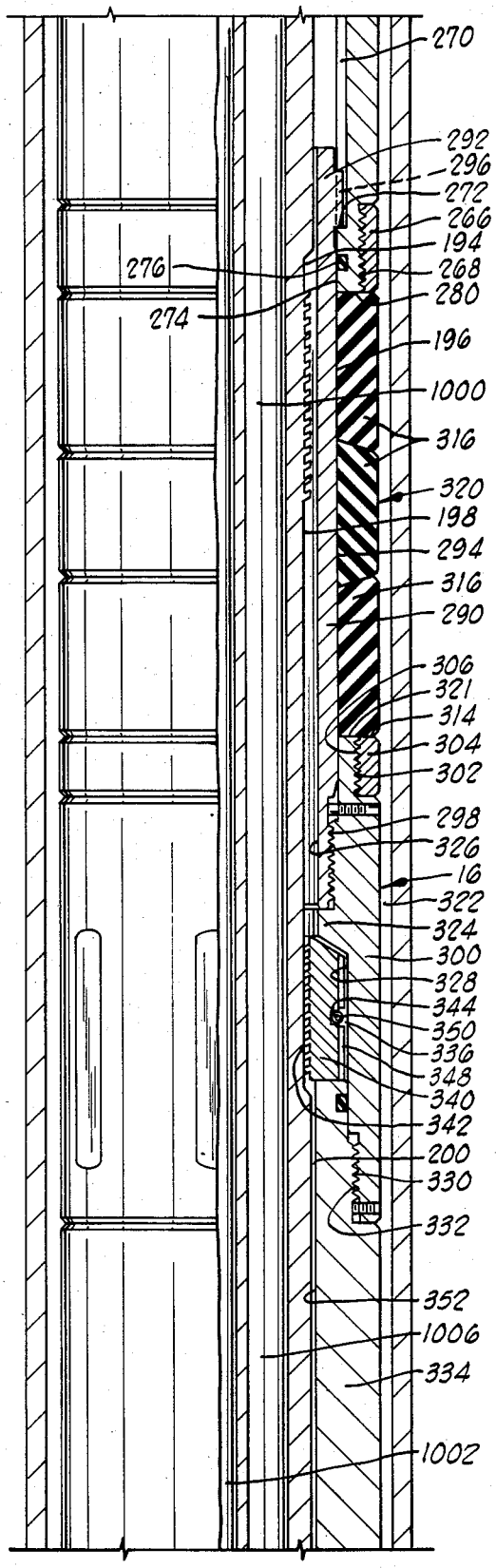
Figure 1E:
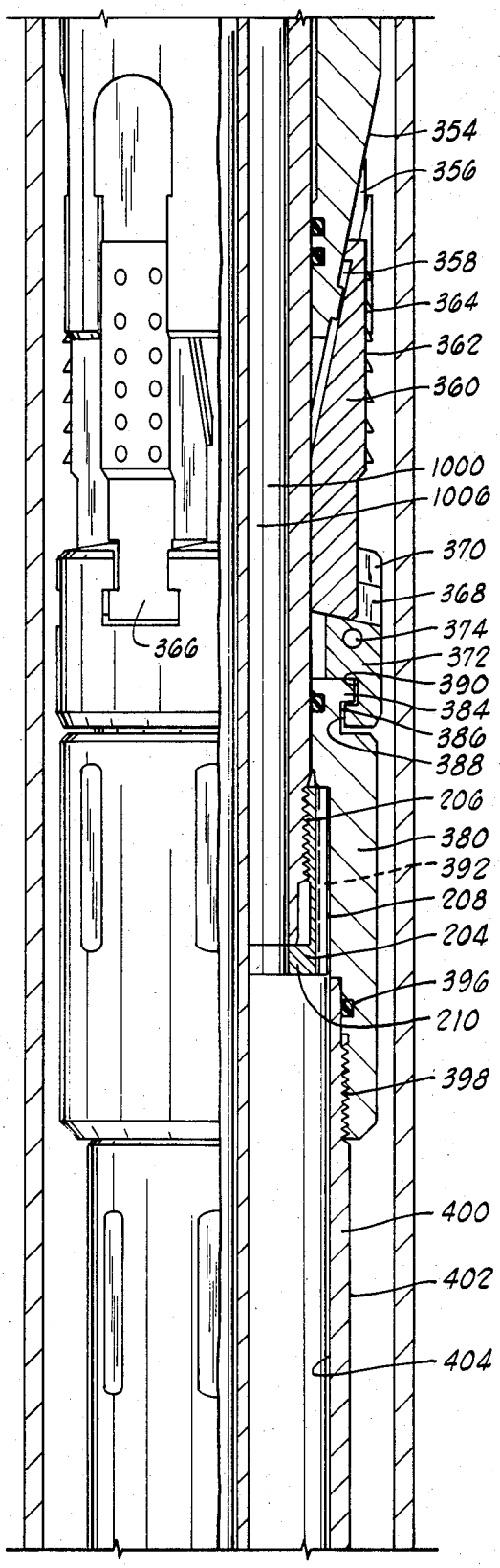
Figure 1F:
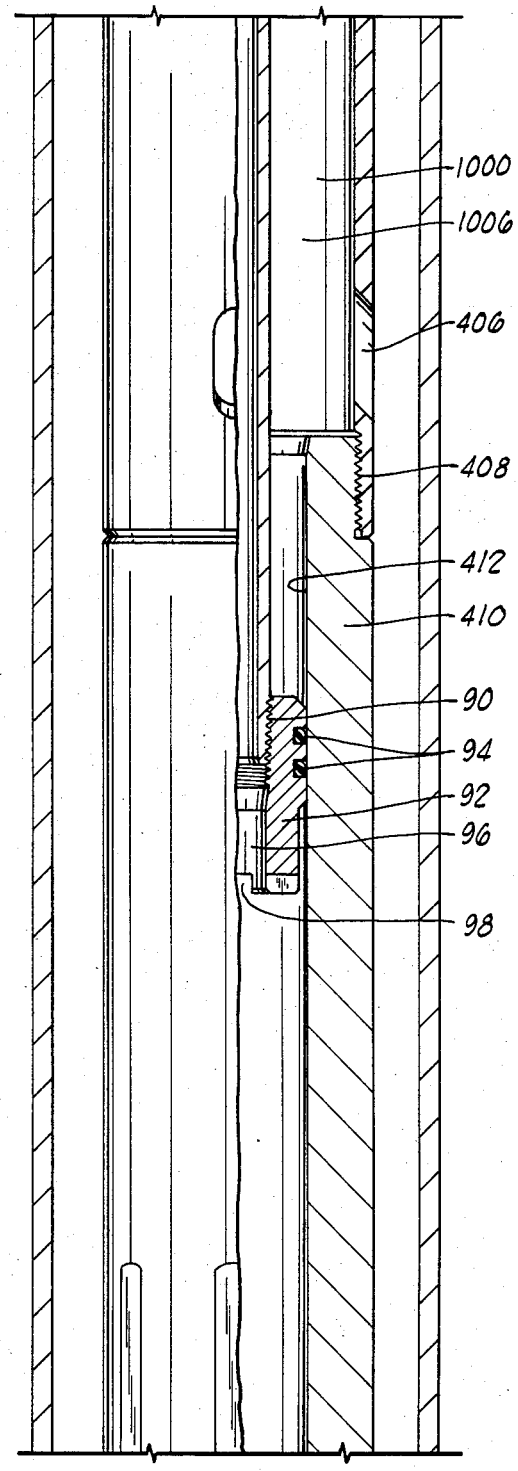
Figure 1G:
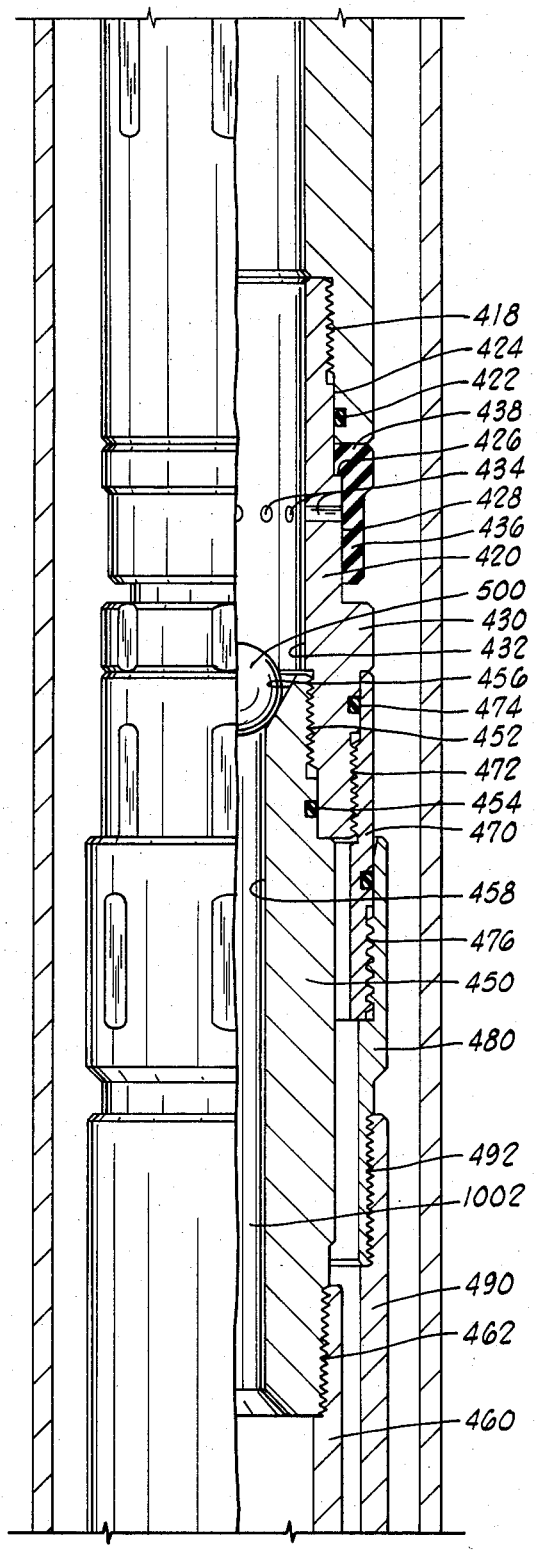

Referring to FIGS. 1A–1G, and 3, gravel packer 10 disposed in wellbore casing or liner 8 comprises crossover assembly 12, mandrel assembly 14 and housing assembly 16.

Crossover assembly 12 includes tubular crossover housing 22 having threaded adapter bore 24 at its upper end to secure gravel packer 10 to a tubing string thereabove. Crossover housing 22 has a cylindrical exterior 26, and an interior below adapter bore 24 including first cylindrical seal bore 28, second cylindrical seal bore 30, and threaded exit bore 32. A plurality of crossover ports 34 extend through the wall of housing 22 to open on second seal bore 30, vent passages 36 and 38 extending through the wall of housing 22 above and below crossover ports 34. Keyway collar 40 is secured by threaded surface 42 to threaded exit bore 32, keyway collar 40 including longitudinal keyways 44 cut in the interior thereof.

Tubular crossover sleeve assembly 46 is slidably disposed in housing 22, upward travel thereof limited by the abutment of keyway collar 40 against annular shoulder 48.

Crossover sleeve assembly 46 includes seal sleeve 50 carrying O-rings 52 thereon, which is secured to crossover body 54 by threads 56, crossover seal 58 interposed therebetween. Crossover tee 60 having T-shaped passage 62 therethrough is an integral part of crossover body 54, and return mandrel 66 is secured thereto at threaded junction 68. Crossover apertures 70 in crossover body 54 are aligned with the horizontally disposed outlets of crossover passage 62, while return mandrel 66 communicates with the bottom outlet thereof. O-ring seal 72 is disposed about crossover body 54 below apertures 70. J-slot housing 74, from which annular shoulder 48 protrudes, is secured at threaded junction 76 to crossover body 54, O-ring 78 effecting a seal therebetween. Longitudinal keys 80 extend radially from J-slot housing 74 into keyways 44 to prohibit mutual rotation between crossover housing 22 and crossover sleeve assembly 46.

Below annular shoulder 48, first J-slots 82 are cut into the exterior of J-slot housing 74, J-slots 82 having open bottoms 84 (see FIG. 3) which communicate with lower seal surface 86, carrying O-rings 88 thereon.

At the lower end of crossover assembly 12, return mandrel 66 is secured at threaded junction 90 to seal body 92, which carries O-rings 94 thereon. The interior of seal body 92 includes upper return bore 96 having slots 98 cut into the bottom thereof.

Crossover housing 22, keyway collar 44, seal sleeve 50, crossover body 54, crossover tee 60, J-slot housing 74, return mandrel 66 and seal body 92 comprise the major elements of crossover assembly 12.

Mandrel assembly 14 includes overshot 130, which rides over the lower end of J-slot housing 74, J-slot lugs 132 protruding radially inward into J-slots 82 from undercut 136. Below undercut 136, seal bore 138 rides against O-rings 88 on J-slot housing 74.

Tubular slip mandrel 140 is secured to overshot 130 at threaded junction 142, O-ring 144 sealing therebetween.

Upper slip assembly 146 rides on slip mandrel 140, biased against annular shoulder 148 by coil spring 150, acting between slip assembly 146 and overshot 130.

Slip assembly 146 includes slip collar 154 which rides on slip mandrel 140 above shoulder 148, slip collar 154 extending downward over lower exterior surface 158 of slip mandrel 140. Longitudinally extending, circumferentially disposed slots 160 extending to the bottom of slip collar 154 accommodate slips 162 therein, laterally extending legs 163 at the upper ends of slips 162 residing in lateral channels 164 of slots 160. Slips 162 have arcuate inner surface 166, leading to oblique bottom surfaces 168, while the exterior of each slip 162 includes a longitudinal slot 170 bounded by slip walls 172 having teeth 174 thereon. Leaf springs 176 contacting the bottoms 178 of slots 170, and anchored by bolts 180 in spring slots 182 of slip collar 154, maintain slips 162 against exterior seal surface 184 of bypass mandrel 186, which is joined to slip mandrel 140 at threaded junction 188, O-ring 190 sealing therebetween.

Bypass mandrel 186 includes cylindrical seal surface 184, at the lower end of which recessed surface 194 possesses left-hand ratchet threads 196 cut thereon. Below ratchet threads 196, smooth dog saddle 198 extends to lower seal surface 200, terminating at threaded junction 206 by which upper bypass mandrel 186 is secured to clutch nut 204. Clutch nut 204 has radially extending keys 208 on the exterior thereof, and annular stop 210 at the bottom thereof, abutting bypass mandrel 186. Bypass ports 220 extend through the wall of bypass mandrel 186.

Mandrel assembly 14 is comprised of the following major elements: overshot 130, spring 150, slip mandrel 140, upper slip assembly 146, bypass mandrel 186, and clutch nut 204.

Housing assembly 16 includes upper slip wedge collar 250, having frusto-conical slip ramp 252 at the top thereof, threaded cylindrical surface 254 therebelow on the exterior, and an axial bore defined by bore wall 256 extending therethrough, through which bypass mandrel 186 is slidably disposed, O-rings 258 and 259 in bore wall 256 of slip wedge collar 250 sealing against upper bypass mandrel 186.

Spline case 260 is secured to collar 250 by threaded entry bore 262 mating with threaded surface 254. Exterior cylindrical surface 264 extends downward to packer compression ring 266, which surrounds the lower end of spline case 260 and is joined thereto at threaded junction 268. The interior of spline case 260 includes longitudinally extending splines 270, which extend substantially to radial shoulder 272, below which the interior necks down to seal bore 274, having an O-ring 276 disposed therein. The lower ends of case 260 and co-extensive packer compression ring 266 provide radially flat upper packer compression shoulder 280.

Tubular packer saddle 290 extends through seal bore 274 of case 260, the upper annular end 292 of saddle 290 being of larger diameter than cylindrical packer element surface 294 and containing longitudinal slots 296 therein which slidably mate with splines 270 on the interior of case 260.

Saddle 290 is secured at threaded junction 298 to adapter 300, adapter 300 having threads 302 on its upper exterior by which lower packer compression ring 304 is secured via thread 306. Lower packer compression ring 304 and the upper face 321 of adapter 300 provide a radially flat lower packer compression shoulder 314. Three annular elastomeric packer elements 316 comprise packer element means 320 and are disposed about packer saddle 290.

The exterior 322 of adapter 300 is substantially cylindrical while the annular shoulder 324 on the interior thereof below threaded junction 298 is cylindrical and of substantially the same diameter as bore 326 of saddle 290, recessed ratchet bore 328 extending to the lower end of adapter 300 therebelow. On the lower interior of adapter 300, threaded surface 330 engages threaded bore 332 on the exterior of lower slip wedge collar 334. Ratchet dog annulus 336, defined between adapter 300, lower slip wedge collar 334 and bypass mandrel 186, contains a plurality of arcuate ratchet dogs 340 having left-hand threads 342 cut on the interior thereof, and circumferentially extending slots 344 on the exterior thereof. Spacer legs 348 protruding into ratchet dog annulus 336 from lower slip wedge collar 334 separate ratchet dogs 340. Spacer legs 348 also contain a circumferential slot therein aligned with slots 344 on dogs 330. A garter spring or elastic band 350 extends through the aligned slots and about ratchet dogs 340 and legs 348.

The bore 352 of collar 334 is substantially the same as that of bore 326 of packer saddle 290. The lower exterior of collar 334 comprises slip ramps 354 separated by spacer walls 356 having undercut therein lateral channels 358 adjacent the surface of ramps 354. Lower slips 360 ride on ramps 354, lateral webs (not shown) extending into channels 358 in walls 356. The upper exterior of slips 360 comprises slip face 362 having teeth 364 thereon. The lower exterior of slips 360 comprises T-shaped strut 366, the laterally oriented ends of which extend into grooves 368 in the sides of strut channels 370 at the upper end of lower slip collar 372, which is comprised of a plurality of arcuate sections secured together by bolts 374 to form a collar.

Clutch collar 380 interlocks via outwardly facing annular shoulder 384 and recess 386 with inwardly facing shoulder 388 and recess 390 on lower slip collar 372 as the arcuate segments forming slip collar 372 are secured together. Clutch collar 380 contains a plurality of longitudinal keyways 392 therein, which accommodate keys 208 of clutch nut 204.

Clutch collar 380 is secured at threaded junction 398 to circulation mandrel 400, O-ring 396 sealing therebetween. Circulation mandrel 400 includes cylindrical exterior 402, cylindrical bore 404, and circulation ports 406 immediately above threaded junction 408 with cylindrical thick-walled seal case 410 therebelow. Seal case 410 includes a seal bore 412 therein, in which seal body 92 secured to return mandrel is disposed.

The lower end of seal case 410 is secured at threaded junction 418 to reversing sleeve 420, O-ring 422 sealing therebetween.

Reversing sleeve 420 includes first cylindrical exterior surface 424, annular lip 426, second cylindrical surface 428, annular shoulder 430, reversing bore 432 and reversing ports 434 extending through the wall thereof. Reversing boot 436 fits about first and second exterior surfaces 424 and 428, annular lip 438 of boot 436 maintaining the boot's position between seal case 410 and annular lip 426.

Ball seat housing 450 is secured at threaded junction 452 to reversing sleeve 420, O-ring 454 sealing therebetween. Frusto-conical check ball seat 456 at the top of housing 450 opens on axial bore 458. The bottom of housing 450 has a tailpipe 460 secured to it at threaded junction 462, tailpipe 460 extending downward into a gravel screen below packer 10.

The bottom of reversing sleeve 420 is secured to tubular left-hand backoff adapter 470 at threaded junction 472, O-ring 474 disposed therebetween. Adapter 470 is secured via left-hand threaded backoff junction 476 to tubular releasing sub 480, which in turn is secured to blank pipe 490 at threads 492, blank pipe 490 having a gravel screen (not shown) disposed therefrom across the producing formation to be gravel packed.

Check ball 500 sits on ball seat 456, ball 500's travel being limited between ball seat 450 and seal body 92, the slots at the bottom of the latter permitting flow around ball 500 into return mandrel 66 by upwardly moving fluid.

Several passages are defined within gravel packer 10, namely intake passage 1000, return passage 1002 and bypass passage 1006. Intake passage 1000 extends from the top of gravel packer 10, around and past crossover tee 60 of crossover body 54, and down the annulus between return mandrel 66 and mandrel assembly 14, to the annulus between return mandrel 66 and circulation mandrel 400 to circulation ports 406, further downward flow being stopped by seal body 92 in the seal body 412 of seal case 410. Return passage 1002 extends from the bottom of ball seat housing past check ball 500 up through reversing sleeve 420, seal case 410 and into seal body 92, through return mandrel 66 and up into crossover tee 60, ending at crossover apertures 70 and ports 34. Bypass passage 1006 extends from bypass ports 220 through the annulus between mandrel assembly 14 and return mandrel 66, and down to circulation ports 406 through the annulus between circulation mandrel 400 and return mandrel 66.

OPERATION OF THE PREFERRED EMBODIMENT

Referring to FIGS. 1A–1G, 2A–2G, and 3, gravel packer 10 may be suspended from a tubing string 6 in wellbore casing or liner 8, with a gravel screen such as is well known in the art suspended therebelow from threaded junction 492; if desired, the distance between gravel packer 10 and the screen may be increased with blank pipe. A washpipe or tailpipe 460 is normally suspended from threaded surface 114 at the end of valve seat housing 450 and extends into the screen, which extends across a producing formation to be gravel packed. As the tubing string 6 is run into the wellbore, fluid can move around packer element means 320 via bypass passage 1006, and the tubing string is filled through circulation ports 406 and intake passage 1000.

After running the tubing string 6 into the wellbore, the bottom of the wellbore is tagged with the gravel screen.

Figure 2A:
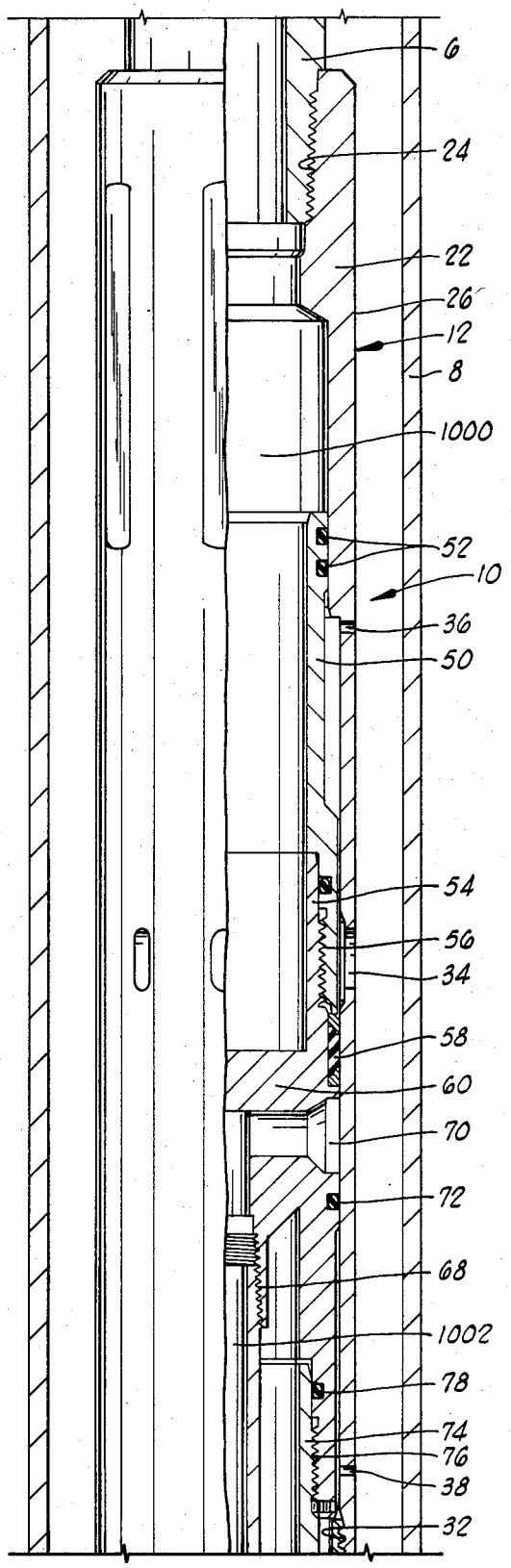
FIGS. 2A–2G comprise a detailed half-section elevation of the gravel packer of the present invention in a set mode.
Figure 2B:
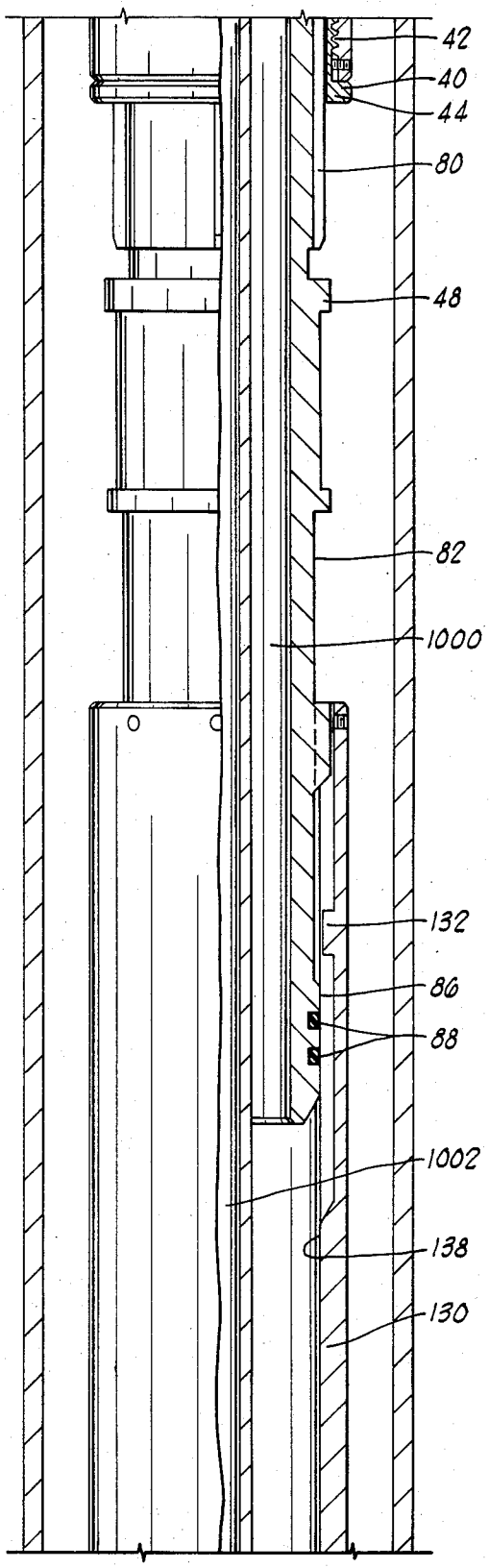
Figure 2C:
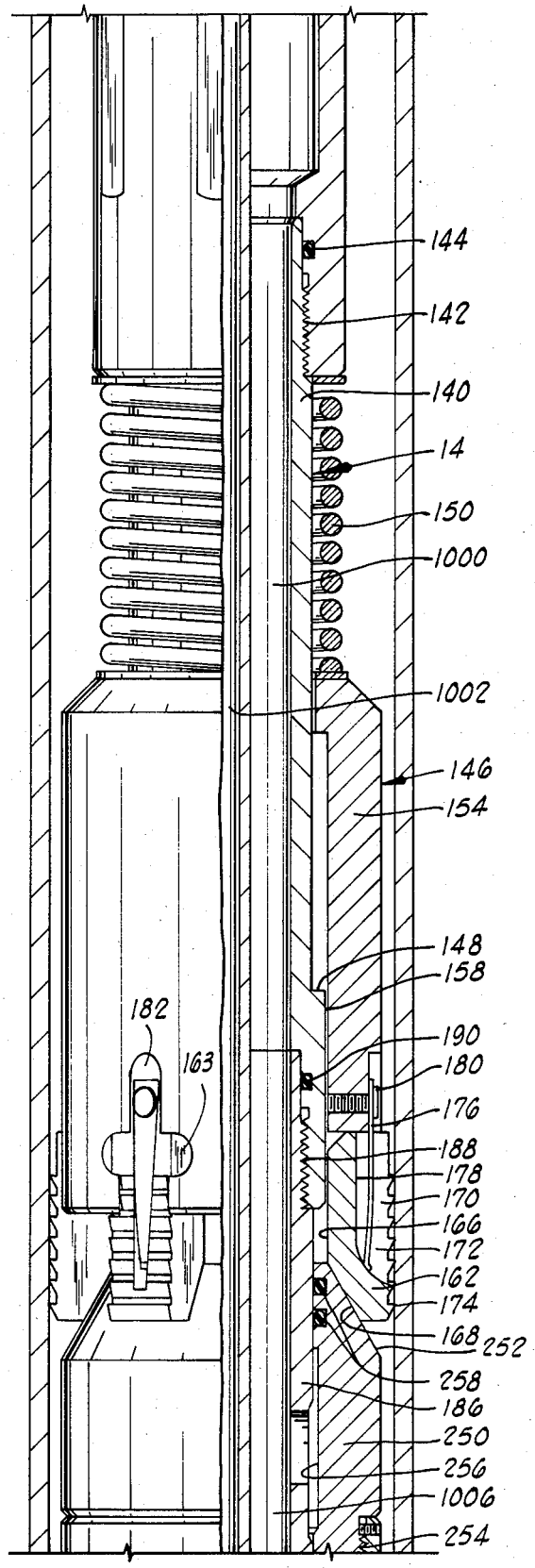
Figure 2D:
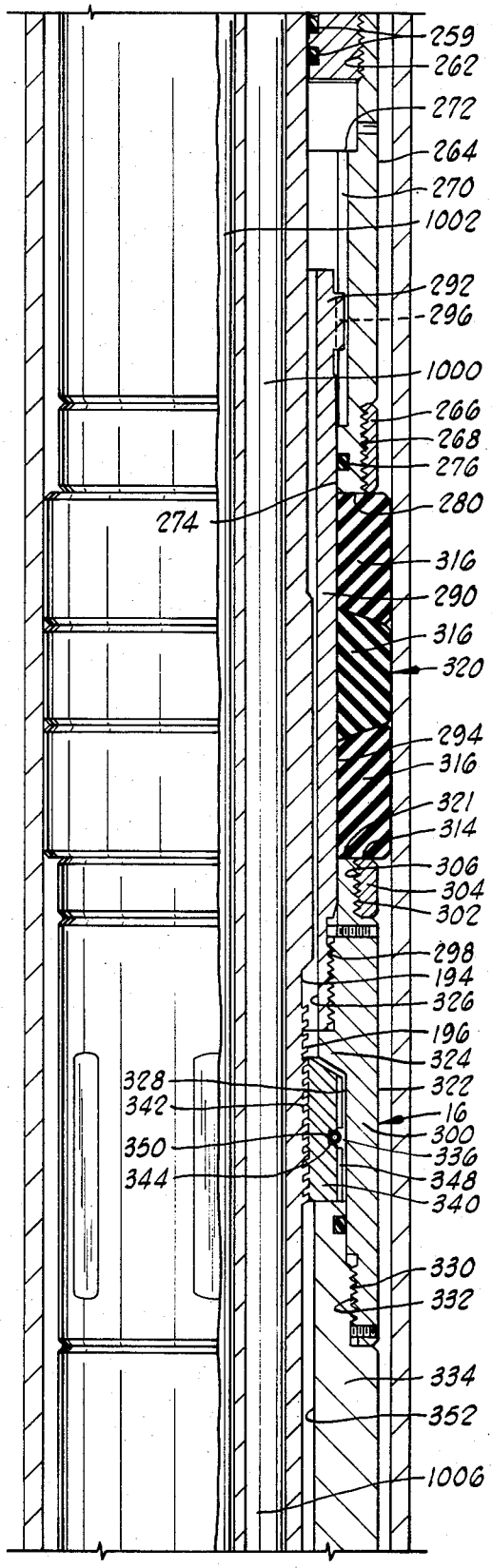
Figure 2E:
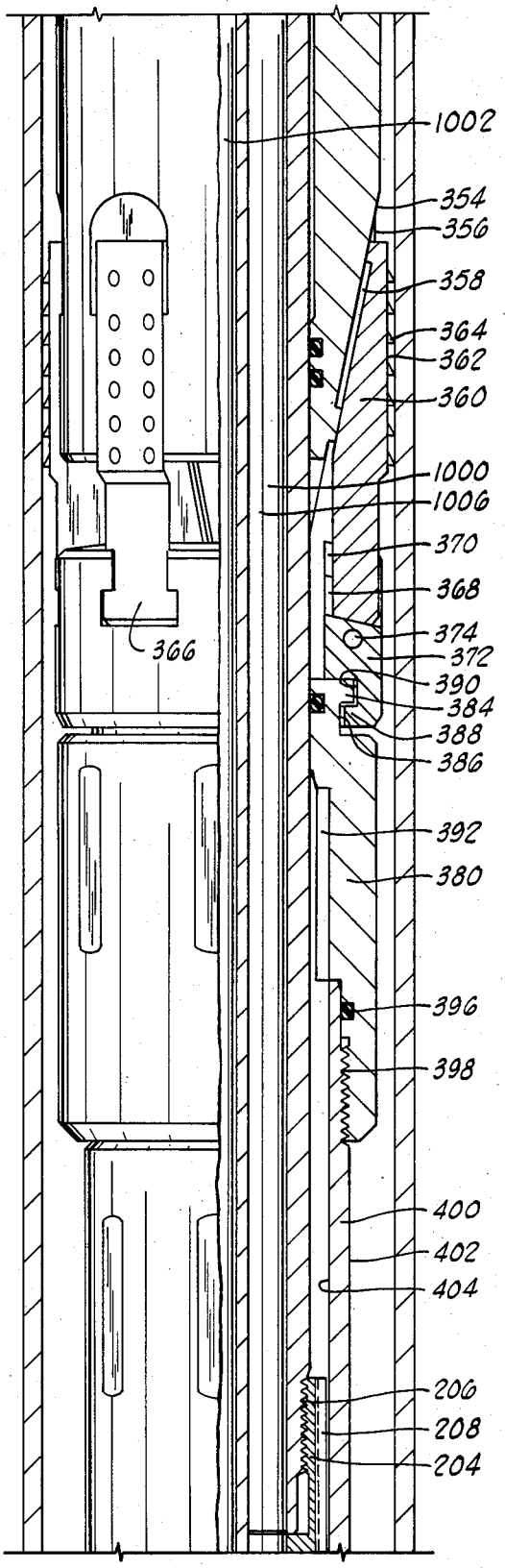
Figure 2F:
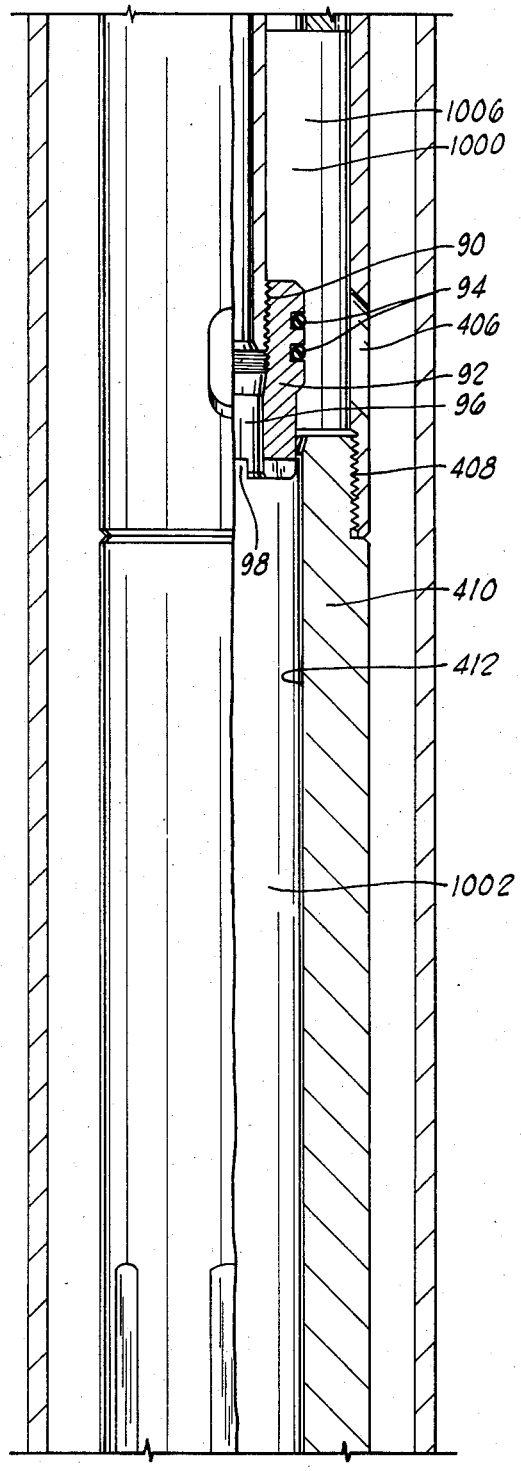
Figure 2G:
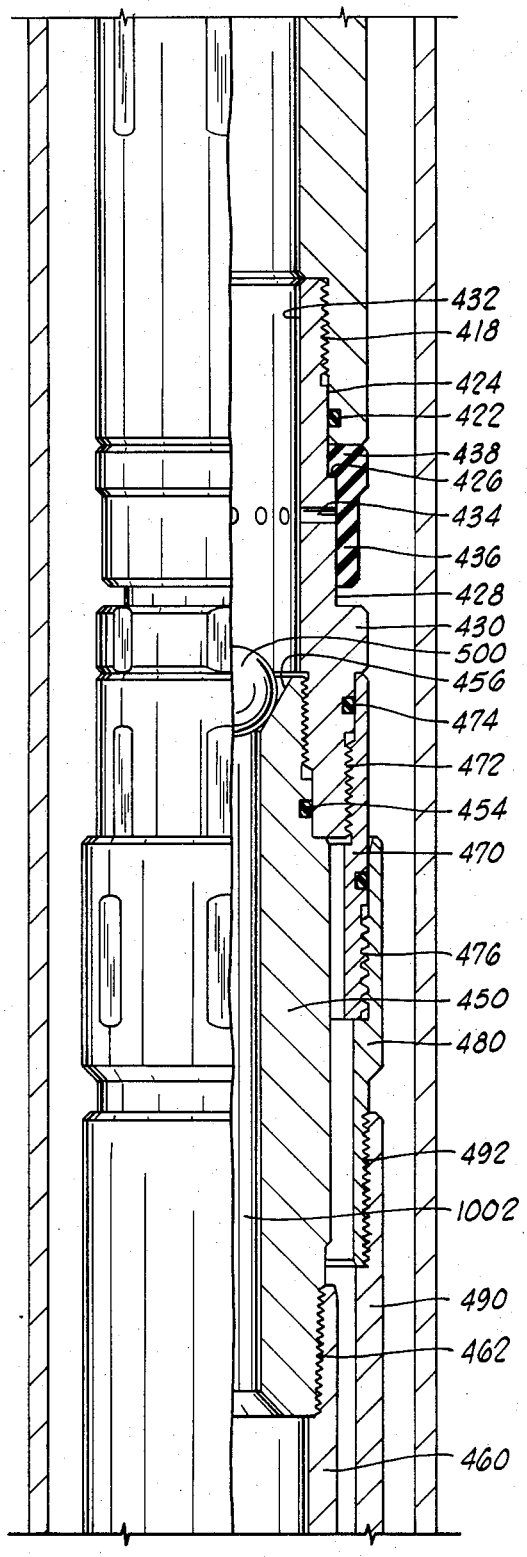
Figure 3:
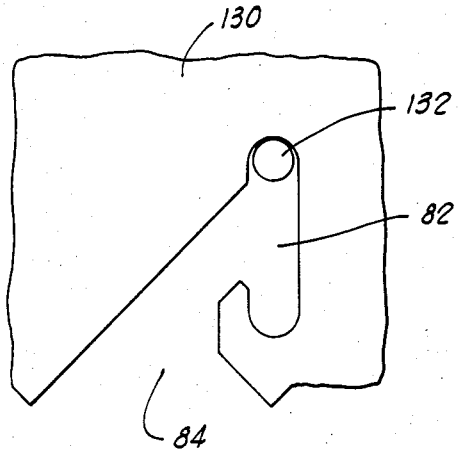
FIG. 3 comprises a development of the J-slot employed in the gravel packer of the present invention.

Gravel packer 10 is set by setting down the tubing string, which sets lower slips 360 against lower slip wedge collar 334 (FIG. 2E) through movement of mandrel assembly 14 with respect to housing assembly 16, the latter's movement being restricted by the gravel screen on the bottom of the wellbore. After lower slips 360 set against casing 8, continued downward travel of mandrel assembly 14 closes bypass passage 1006 (FIG. 2C) by bringing bypass ports 220 between O-rings 258 and 259 at which time upper slip assembly 146, biased by spring 150, contacts upper slip wedge collar 250 and forces it and spline case 260 downward, compressing packer element means 320 against casing 8 (FIG. 2D) after which upper slips 162 contact and set against casing 8 (FIG. 2C). The downward travel of mandrel means assembly 14 results in ratchet dogs 340 engaging ratchet teeth 196 (FIG. 2D), locking gravel packer 10 in a set mode, spring 150 aiding in maintaining it therein. The packer is then pulled upward by the tubing string to test the ratchet engagement and upper slips, closing crossover assembly 12, and the annulus between the tubing string 6 and casing 8 is pressured up to test the seal of packer element means 320 against casing 8.

To gravel pack, the tubing string 6 is set down to open crossover assembly 12 by placing crossover apertures 70 in communication with crossover ports 34. Circulation is then established through passage 1000, through circulation ports 406, into the annulus below gravel packer 10, down to the gravel screen and through the apertures therein, up the washpipe 460 into return passage 1002, out of crossover assembly 12 through apertures 70 and ports 34, and up the annulus above gravel packer 10 to the surface.

The desired fluid injection rate is then established by pulling up on the tubing string to close crossover assembly 12, and pressuring up the tubing until it is ascertained that fluid can be pumped into the formation at a desired rate and pressure. If not, the formation may have to be treated with acid to increase its permeability. If the injection rate is satisfactory, bypass ports 220 can then be opened to "spot" the gravel-laden slurry to gravel packer 10 by pulling against the tubing string, applying pressure to the annulus, rotating the tubing string to the right 12 to 16 turns to release ratchet dogs 340 from ratchet threads 196 and uncover bypass ports 220, indicated at the surface by a relieving of the pressure in the annulus. Slurry can then be spotted down to the gravel packer 10 without circulating fluid through the gravel screen, as fluid below packer element means 320 will be displaced upward into the annulus via bypass ports 220 by the slurry traveling down the tubing string and into intake passage 1000. After slurry spotting, the tubing string is set down to close bypass ports 220 and open crossover assembly 12. The slurry is circulated out ports 406 and down to the screen, the gravel being deposited outside the screen adjacent the formation, fluid returns being taken up the tailpipe 460 into return passage 1002 past unseated check ball 500, through crossover assembly 12 to the annulus above gravel packer 10.

After the gravel pack is placed, the tubing string is again pulled against the set gravel packer 10 to close crossover assembly 12, and the pack slurry is squeezed into the formation and against the screen through intake passage 1000, circulation ports 406 and the lower annulus below gravel packer 10. If desired, the operator may alternate between circulating and squeezing several times to place more gravel and ensure the integrity of the pack. It should be noted that gravel packer 10 permits squeezing without subjecting the casing above packer element means 320 to squeeze pressure, an important feature in wells with old or otherwise deteriorated casing.

Excess slurry can be reverse circulated out of the tubing string gravel packer 10 and the annulus thereabove, by circulating clean fluid down the annulus to crossover assembly 12, down return passage 1002 where check ball 500 is seated on ball seat 456, out reversing ports passage 434 past boot 436, into circulation ports 406 and up intake passage 1000 to the surface through the tubing string.

The gravel pack can be retested if desired in the circulate and/or squeeze mode, and repacking done if necessary, in the same manner described above.

Mandrel assembly 14 and housing assembly 16 may then be left in the wellbore as a permanent production packer assembly. This may be effected by applying left-hand torque to the tubing string and picking up, which disengages J-slots 82 from lugs 132 (see FIG. 2B). Crossover assembly 12 is then withdrawn from mandrel assembly 14 and out of the wellbore on tubing string 6. A tubing seal assembly at the end of production tubing may then be stabbed into seal bore 138 and the packed formation produced through mandrel assembly 14 and housing assembly 16.

If necessary, gravel packer 10 may be backed off from blank pipe 490 via left-handed backoff junction 476 by continued right-handed rotation of the tubing string 6 after ratchet threads 196 and ratchet dogs 340 are backed off, and gravel packer 10 unset. In this instance, a tubing seal assembly and production packer can be run down to blank pipe 490 to produce the well.

Thus has been described a novel and unobvious method and apparatus for gravel packing a well. Of course, numerous additions, deletions and modifications to the preferred embodiment of the apparatus may be made without departing from the spirit and scope of the invention, as defined by the following claims.

We claim:

1. A gravel packer for placing a gravel pack in a wellbore about a gravel screen disposed therebelow across a producing formation comprising:

a gravel packer assembly;

a packer element disposed on the exterior of said assembly;

ratchet means in said assembly for reselasably locking said packer element in a set mode;

an intake passage in said assembly for receiving fluid from a tubing string in said well bore above and secured to said gravel packer and guiding said fluid to a location below said packer element in said assembly;

a return passage disposed in said assembly for receiving fluid from the interior of said gravel screen;

a circulation passage extending from the exterior of said gravel packer below said packer element to said intake passage;

closeable crossover means at the upper end of said return passage adapted to receive fluid therefrom and guide said received fluid from said return passage to the exterior of said assembly above said packer element;

first check valve means in said return passage for preventing flow to said gravel screen through said return passage;

second check valve means above said first check valve means adapted to selectively communicate said return passage and the exterior of said gravel packer below said packer element in response to a positive pressure differential between said return passage and the exterior of said gravel packer; and J-slot means above said packer element and ratchet means for selectively disconnecting said crossover means, the upper portion of said return passage and said tubing string from said assembly in response to longitudinal and rotational movement of said tubing string.

2. The apparatus of claim 1, wheerin said packer element is a compression-set packer element which is compressible through longitudinal tubing string movement to a set mode after said J-slot means is disengaged by said longitudinal and rotational movement of said tubing string, said assembly further including packer compression means responsive to longitudinal tubing string movement.

3. The apparatus of claim 2, further including upper and lower slip means extendable to a set mode through longitudinal tubing string movement.

4. The apparatus of claim 1, wherein said crossover means is closeable through longitudinal movement of said tubing string.

5. The apparatus of claim 1, wherein said first check valve means is inactivated through disconnection and removal of said crossover means and the upper portion of said return passage from said gravel packer assembly.

6. A gravel packer for placing a gravel pack in a wellbore about a gravel screen disposed therebelow across a producing formation, comprising:

a crossover assembly including a ported crossover housing secured to said tubing string and having a crossover sleeve slidably disposed therein, said sleeve assembly containing a tee-shaped passage extending from apertures on the exterior of said sleeve assembly to a tubular return mandrel disposed therebelow and secured to said sleeve assembly;

first J-slot means at the lower end of said sleeve assembly, and a seal body with an axial bore therethrough at the lower end of said return mandrel;

a mandrel assembly including overshot means at the upper end thereof having second J-slot means engaged with said first J-slot means associated therewith, tubular mandrel means below said overshot, an upper slip assembly disposed about said mandrel means and first ratchet means associated with said mandrel means below said slip assembly; and a housing assembly including an upper slip wedge, a compressible packer element, packer element compression means responsive to relative longitudinal movement between said mandrel and housing assemblies, second ratchet means, a lower slip wedge, a lower slip assembly, tubular housing mandrel means below said lower slip assembly having circulation ports therethrough and a seal bore below said circulation ports in slidable sealing engagement with said seal body, reversing ports below said seal bore, reversing boot means associated with said reversing ports, a ball seat below said reversing ports, a check ball disposed on said ball seat, and an axial bore below said ball seat.

7. The apparatus of claim 6, wherein said gravel packer further includes a closeable bypass passage extending between said return mandrel and said mandrel assembly mandrel means from above said packer element to below said packer element.

8. The apparatus of claim 7, wherein said bypass passage is closeable through relative longitudinal movement of said mandrel and housing assemblies.

9. The apparatus of claim 6, further including upper and lower slip means expandable to a set mode through relative longitudinal movement between said mandrel and housing assemblies.

10. The apparatus of claim 6, wherein said first J-slot means comprises at least one J-slot lug radially extending from said mandrel assembly overshot into a J-slot associated with said crossover sleeve assembly, said J-slot comprising said second J-slot means.

11. The apparatus of claim 6, wherein said first ratchet means comprises a left-hand ratchet thread on the exterior of said mandrel assembly mandrel means, and said second ratchet means comprises a plurality of radially inwardly biased ratchet dogs having left-hand threads on the insides thereof engageable with said mandrel assembly threads.

12. The apparatus of claim 6, wherein said reversing boot means comprises an elastomeric reversing boot disposed about said housing mandrel means over said reversing ports.

13. The apparatus of claim 6, wherein said crossover assembly is closeable through longitudinal misalignment of said apertures in said sleeve with said ports in said housing, said misalignment being effected through longitudinal movement of said tubing string.

14. The apparatus of claim 6, wherein said crossover assembly is removable from said gravel packer upper disengagement of said first J-slot means from said second J-slot means.

15. The apparatus of claim 14, wherein said first J-slot means comprises at least one J-slot lug radially extending from said mandrel assembly overshot into a J-slot associated with said crossover sleeve assembly, said J-slot comprising said second J-slot means.

16. The apparatus of claim 15, wherein said first ratchet means comprises a left-hand ratchet thread on the exterior of said mandrel assembly, and said second ratchet means comprises a plurality of radially inwardly biased ratchet dogs associated with said housing assembly and having left-hand threads on the insides thereof engageable with said mandrel assembly threads.

17. The apparatus of claim 16, wherein said gravel packer further includes a closeable bypass passage extending between said return mandrel and said mandrel assembly mandrel means from above said packer element to below said packer element.

18. The apparatus of claim 17, wherein said bypass passage is closeable through relative longitudinal movement of said mandrel and housing assemblies.

* * * * *